US007563218B2

(12) United States Patent
Thoma

(10) Patent No.: US 7,563,218 B2
(45) **Date of Patent: *Jul. 21, 2009**

(54) METHOD FOR CONTROLLING OR REGULATING A FOLDER OF A PRINTING PRESS

(75) Inventor: August Thoma, Bonstetten (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/386,264

(22) Filed: Mar. 22, 2006

(65) Prior Publication Data

US 2006/0217253 A1 Sep. 28, 2006

(30) Foreign Application Priority Data

Mar. 23, 2005 (DE) ..... 10 2005 013 361

(51) Int. Cl.
*B31B 1/34* (2006.01)

(52) U.S. Cl. ..... 493/23; 493/25; 493/34; 493/321

(58) Field of Classification Search ..... 493/23, 493/25, 34, 321

See application file for complete search history.

(56) References Cited

U.S. PATENT DOCUMENTS

| | | | | |
|---|---|---|---|---|
| 4,578,052 A | | 3/1986 | Engel et al. | |
| 5,390,601 A | * | 2/1995 | Fricke et al. | 101/409 |
| 5,443,437 A | * | 8/1995 | Mack | 493/359 |
| 5,724,437 A | * | 3/1998 | Bucher et al. | 382/112 |
| 5,865,120 A | * | 2/1999 | Gross | 101/483 |
| 6,024,682 A | | 2/2000 | Mandel et al. | |
| 6,070,391 A | | 6/2000 | Honegger | |
| 6,095,043 A | * | 8/2000 | Hartmann et al. | 101/183 |
| 6,319,182 B1 | * | 11/2001 | Schneider | 493/10 |
| 6,606,944 B1 | | 8/2003 | Athans et al. | |
| 6,641,514 B1 | | 11/2003 | Hechler | |
| 2005/0247220 A1 | * | 11/2005 | Brandenburg et al. | 101/226 |

FOREIGN PATENT DOCUMENTS

| | | |
|---|---|---|
| DE | 31 20 526 A1 | 6/1982 |
| DE | 196 29 072 A1 | 1/1998 |
| DE | 197 40 153 C2 | 3/1999 |
| JP | 2001-171908 | 6/2001 |

* cited by examiner

*Primary Examiner*—Hemant M Desai
(74) *Attorney, Agent, or Firm*—Crowell & Moring LLP

(57) ABSTRACT

A method and apparatus for controlling or regulating a folder of a printing press is disclosed. Setpoint fold values are generated on the basis of prepress stage data and printed copies are measured in the folded and/or partially folded state in order to determine actual fold values. The actual fold values which are determined in the process are compared with the corresponding setpoint fold values and, as a function of this comparison, the folder is set automatically in such a way that the actual fold values correspond to or are approximated to the setpoint fold values in subsequent printed copies.

7 Claims, 1 Drawing Sheet

METHOD FOR CONTROLLING OR REGULATING A FOLDER OF A PRINTING PRESS

This application claims the priority of German Patent Document No. 10 2005 013 361.4, filed Mar. 23, 2005, the disclosure of which is incorporated by reference herein.

BACKGROUND AND SUMMARY OF THE INVENTION

The invention relates to a method for controlling or regulating a folder of a printing press. Furthermore, the invention relates to a printing press having a folder.

Folders of printing presses serve to form folds on printed printing materials, a web-shaped printing material customarily being guided first of all through what is known as a folding former for fold formation according to the prior art, in order for a longitudinal fold to be formed in this way on the web-shaped printing material which has not yet been severed. Starting from the folding former, the web-shaped printing material is transported via several pull rolls in the direction of a cutting knife cylinder and a folding blade cylinder which interacts with the cutting knife cylinder, copies which are moved in the direction of a folding jaw cylinder with the aid of a folding blade cylinder being severed from the web-shaped printing material on the cutting knife cylinder. The copies which are severed from the web-shaped printing material on the cutting knife cylinder and are moved in the direction of the folding jaw cylinder by the folding blade cylinder are transferred to the folding jaw cylinder with formation of a first crossfold by the folding blade cylinder. Further, second crossfolds can be formed between the folding jaw cylinder and a gripper cylinder which interacts with the latter. The copies which have been provided in this way with a longitudinal fold and crossfolds can then be provided with second longitudinal folds while still in the region of a folding table which is connected behind the gripper cylinder, the second longitudinal folds running parallel to the longitudinal fold which was formed in the folding former.

If the fold formation is to be checked according to the prior art, a folded printed copy is removed from a printing press, unfolded and examined in the unfolded state by a printer. If the printer notices here that folds run obliquely, actuators for the folding former and/or the folding blade cylinder and/or the folding jaw cylinder and/or the folding table are adjusted manually by the printer in such a way that the desired fold is formed on subsequent printed copies. Here, the procedure is purely empirical according to the prior art, with the result that there are no reproducible results during the adjustment of the folder which is performed by the printer.

Proceeding from this, the present invention is based on the problem of providing a novel method for controlling or regulating a folder, and also of providing a printing press with a folder.

According to the invention, setpoint fold values are generated on the basis of prepress stage data, printed copies being measured in the folded and/or partially folded state in order to determine actual fold values, the actual fold values which are determined in the process being compared with the corresponding setpoint fold values, and, as a function of this comparison, the folder being set automatically in such a way that the actual fold values correspond to or are approximated to the setpoint fold values in subsequent printed copies.

In the context of the present invention, it is provided for the first time to regulate or control a folder on the basis of setpoint fold values which are generated from prepress stage data. For this purpose, printed copies are measured in the folded and/or partially folded state in order to determine actual fold values, the actual fold values which are determined in the process being compared with the setpoint fold values which are based on the prepress stage.

As a function of this comparison, actuating signals are determined for the actuators of the folder, in order to set the folder automatically in this way. As a result, it is possible to achieve reproducible results during the setting of folders. Furthermore, the method according to the invention can run fully automatically, with the result that an intervention by a printer is unnecessary.

BRIEF DESCRIPTION OF THE DRAWINGS

Preferred developments of the invention result from the following description. Without being restricted thereto, one exemplary embodiment of the invention will be described in greater detail using the drawing, in which.

DETAILED DESCRIPTION OF THE DRAWINGS

Figure 1:
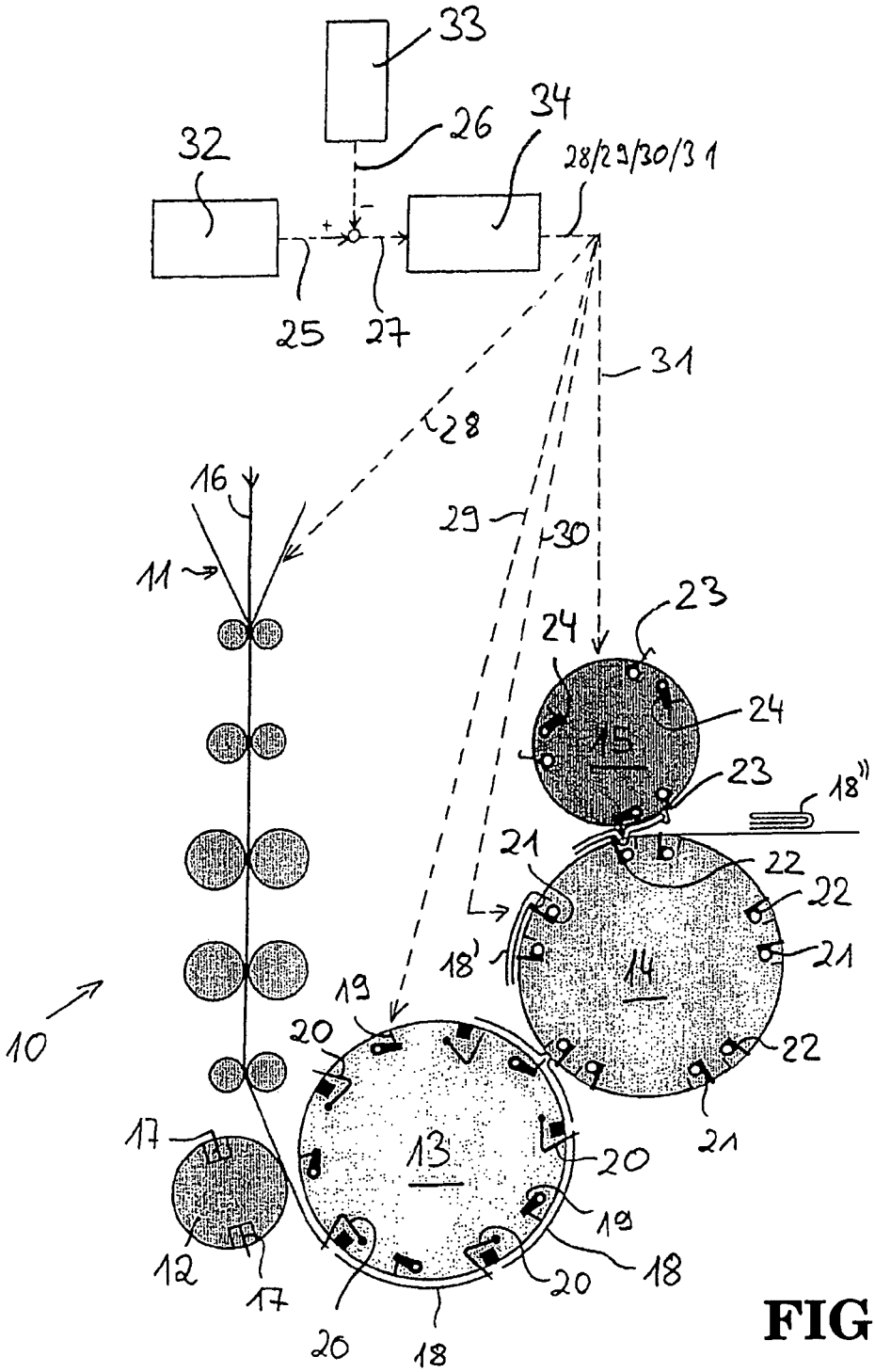
FIG. 1 shows a diagrammatic detail of a folder of a printing press according to the principles of the present invention.

In the following text, the present invention will be described in greater detail with reference to FIG. 1.

The principle method of operation of folders is known in principle to one skilled in the art addressed here and therefore does not require a detailed explanation. At this point, it is to be pointed out for the sake of completeness that a folder 10 for a printing press usually comprises a folding former 11, a cutting knife cylinder 12, a folding blade cylinder 13, a folding jaw cylinder 14 and a gripper cylinder 15. A printing material 16 is moved or guided through the folder 10. What is known as a first longitudinal fold is produced in the region of the folding former 11 and what is known as a first crossfold is produced in the region between the folding blade cylinder 13 and the folding jaw cylinder 14. In the exemplary embodiment shown, second crossfolds are produced between the folding jaw cylinder 14 and the gripper cylinder 15. A folding table (not shown) can be arranged after the gripper cylinder 15 in order to produce second longitudinal folds which run parallel to the longitudinal fold which was produced in the folding former 11.

The cutting knife cylinder 12 comprises at least one cutting knife 17. Copies 18 can be severed with the aid of the cutting knives 17 from the printing material 16 which has been prefolded with a longitudinal fold in the region of the folding former 11. The folding blade cylinder 13 comprises folding blades 19 and perforating needles 20 or grippers. The folding jaw cylinder 14 has folding jaws 21, 22 and the gripper cylinder 15 has grippers 23 and folding blades 24.

In order to provide a first crossfold, the cutting knife cylinder 12, the folding blade cylinder 13 and the folding jaw cylinder 14 interact in such a way that, when a copy 18 is severed from the printing material 16 with the aid of a cutting knife 17 of the cutting knife cylinder 12, the severed copy 18 is held at the start of the sheet by a perforating needle 20 or a gripper and is moved further by rotation of the folding knife cylinder 13. As a result, the severed copy 18 is moved into a relative position between the folding blade cylinder 13 and the folding jaw cylinder 14, which relative position is defined for the formation of the first crossfold, a folding blade 19 of the folding blade cylinder 13 pressing the copy 18 between opened first folding jaws 21 of the folding jaw cylinder 14 when this relative position is reached, whereas the perforating needle 20 or the gripper releases the copy 18. The copy 18' which has thus been provided with the first crossfold and is held by the folding jaw cylinder 14 is then moved further in the direction of the gripper cylinder 15 by rotation of the folding jaw cylinder 14.

In the exemplary embodiment of FIG. 1, at least one second crossfold is formed between the folding jaw cylinder 14 and the gripper cylinder 15. This takes place in that a copy 18' which is provided with a first crossfold is moved into a defined relative position between the folding jaw cylinder 14 and the gripper cylinder 15, the first folding jaw 21 of the folding jaw cylinder 14 being opened in this relative position, a gripper 23 of the gripper cylinder 15 gripping that section of the copy 18' which is released by the first folding jaw 21, and a folding blade 24 of the gripper cylinder 15 pressing the copy 18' between an opened second folding jaw 22 of the folding jaw cylinder 14. The copy 18" which is provided thus with first and second crossfolds is subsequently released from the folding jaw cylinder 14 and fed to a further processing step, for example the formation of second longitudinal folds in the region of the folding table (not shown).

In the context of the present invention, it is provided to regulate a folder 10 of a printing press by the fact that setpoint fold values 25 are generated on the basis of prepress stage data, that printed copies are measured in the folded and/or partially folded state in order to determine actual fold values 26, that the actual fold values 26 are compared with the setpoint fold values 25 in order to determine fold deviations 27, and that, as a function of this comparison or of the fold deviations 27, manipulated variables 28, 29, 30 and 31 are determined for the folder 10, in order to set the folder 10 automatically in such a way that the actual fold values 26 correspond to or are approximated to the setpoint fold values 25 in subsequent printed copies.

The manipulated variables which are determined on the basis of the fold deviations 27 are manipulated variables 28 for the folding former 11 and/or manipulated variables 29 for the folding blade cylinder 13 and/or manipulated variables 30 for the folding jaw cylinder 14 and/or manipulated variables 31 for the gripper cylinder 15. Furthermore, manipulated variables (not shown) can be generated for a folding table which is connected behind the gripper cylinder 15. The manipulated variables 28 for the folding former 11 usually influence turner bars in a folder superstructure.

As has already been mentioned, it lies within the context of the present invention to generate the setpoint fold values 25 on the basis of prepress stage data. According to FIG. 1, this takes place in a setpoint generating device 32 which is supplied with digital prepress stage data, with the result that the setpoint generating device 32 can generate setpoint fold values 25 which are dependent on the printed image or subject on the basis of the prepress stage data. On the basis of the subject-based prepress stage data, setpoint spacings of setpoint folds which are to be performed in the folder 10 or setpoint fold lines with respect to a printed image or with respect to selected regions of a printed image are generated, with consideration of the longitudinal folds and/or crossfolds which are to be performed in the folder 10 as setpoint fold values 25. During the determination of the actual fold values 26, actual spacings of the actually performed actual folds or actual fold lines with respect to the printed image or with respect to the selected regions of the printed image are then determined on the folded or partially folded printed copy. This measuring of the printed copies in the folded and/or partially folded state takes place with the aid of at least one measuring device 33.

In order to determine the fold deviations 27, the actual spacings which are determined by measuring between the actually performed actual folds and the printed image and the generated setpoint spacings between the setpoint folds which are to be performed and the printed image are compared with one another, the fold deviations 27 being supplied to a regulating device 34 which then generates the manipulated variables 28 to 31 for the folder 10 on the basis of the fold deviations 27.

In the context of the present invention, the actual fold values can be determined within the folder 10 in an online manner with respect to the folding process. Thus, for example, a measuring device can be integrated into the folder 10 in an adjoining manner to the folding former 11, in order to measure the longitudinal fold which is produced in the region of the folding former 11 and to generate a corresponding actual fold value. Further measuring devices can likewise be integrated into the folder 10, in order to generate, for example, corresponding setpoint fold values for first crossfolds which are produced between the folding blade cylinder 13 and the folding jaw cylinder 14 and for second crossfolds which are produced between the folding jaw cylinder 14 and the gripper cylinder 15. A measuring device can likewise be integrated into the folding table (not shown), in order to measure the second longitudinal folds which are produced in the region of the folding table. In this case, the correspondingly folded or partially folded printed copy would accordingly be measured immediately after a fold has been performed, in order to provide a corresponding actual fold value for the previously performed fold. All the actual fold values are then determined online and automatically in the folder 10 and compared automatically with the corresponding setpoint fold values which are based on the prepress stage, for regulating purposes. The folder 10 is then regulated in a fully automated manner, without it being necessary for a printer to intervene.

As an alternative, the actual fold values can also be determined outside the folder 10 in an offline manner with respect to the folding process. In this case, for example, a folded printed copy is then removed by a printer and measured in the folded and partially folded state with the aid of corresponding measuring devices. Actual fold values which are measured in the process can then be used for the automatic setting of the folder 10, as described above.

Accordingly, the present invention provides a method and apparatus for controlling or regulating a folder, in which setpoint fold values are generated on the basis of prepress stage data. Accordingly, the present invention establishes image data-based regulation or control of a folder.

List of Reference Numerals

10 Folder
11 Folding former
12 Cutting knife cylinder
13 Folding blade cylinder
14 Folding jaw cylinder
15 Gripper cylinder
16 Printing material
17 Cutting knife
18, 18', 18" Copy
19 Folding blade
20 Perforating needle
21 Folding jaw
22 Folding jaw
23 Gripper
24 Folding blade
25 Setpoint fold value
26 Actual fold value
27 Fold deviation

28 Manipulated variable
29 Manipulated variable
30 Manipulated variable
31 Manipulated variable
32 Setpoint generating device
33 Measuring device
34 Regulating device The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for controlling or regulating a folder of a printing press, the method comprising steps of:

generating setpoint fold values on a basis of prepress stage data in a manner that setpoint spacings of setpoint folds with respect to a printed image are generated on the basis of the prepress stage data and on a basis of longitudinal folds and/or crossfolds which are performed in the folder;

measuring printed copies in a folded and partially folded state in order to determine actual fold values in a manner that actual spacings of actual folds with respect to the printed image are determined during the determination of actual fold values;

comparing the actual fold values which are determined with the corresponding setpoint fold values; and setting automatically the folder as a function of this comparison, in such a way that the actual fold values correspond to or are approximated to the setpoint fold values in subsequent printed copies.

2. The method according to claim 1, wherein setpoint fold values which are dependent on a subject or printed image are generated on the basis of prepress stage data.

3. The method according to claim 1, wherein the actual spacings are compared with setpoint spacings and wherein the folder is regulated automatically as a function of this comparison.

4. The method according to claim 1, wherein actuating devices of a folding former and/or of a folding blade cylinder and/or of a folding jaw cylinder and/or of a gripper cylinder and/or of a folding table of the folder are set automatically as a function of the comparison between the actual fold values and the setpoint fold values.

5. The method according to claim 1, wherein in order to determine the actual fold values, the printed copies are measured in the folded and/or partially folded state within the folder in an online manner with respect to a folding process.

6. The method according to claim 1, wherein, in order to determine the actual fold values, the printed copies are measured in the folded and/or partially folded state outside the folder in an offline manner with respect to a folding process.

7. The method according to claim 1, further comprising steps of:

determining fold deviations as a function of the comparison;

supplying the fold deviations to a regulating device and wherein the regulating device generates respective manipulated variables for a folding former, a folding blade cylinder, a folding jaw cylinder, and a gripper cylinder of the folder with each of the respective manipulated variables based on the same fold deviations, and wherein the regulating device supplies the respective manipulated variables to each of the folding former, the folding blade cylinder, the folding jaw cylinder, and the gripper cylinder for controlling the folder.

* * * * *